United States Patent [19]

Voorhis

[11] 4,362,030

[45] Dec. 7, 1982

[54] REFRIGERATION CIRCUIT

[75] Inventor: Roger J. Voorhis, Liverpool, N.Y.

[73] Assignee: Carrier Corporation, Syracuse, N.Y.

[21] Appl. No.: 298,817

[22] Filed: Sep. 2, 1981

[51] Int. Cl.[3] ..... F25B 1/10

[52] U.S. Cl. ..... 62/510; 62/196 A

[58] Field of Search ..... 62/196 A, 196 R, 155, 62/510

[56] References Cited

U.S. PATENT DOCUMENTS

| | | | |
|---|---|---|---|
| 3,238,738 | 3/1966 | Webber | 62/196 |
| 4,236,876 | 12/1980 | Fraser et al. | 417/250 |
| 4,268,291 | 5/1981 | Cann | 62/117 |

*Primary Examiner*—Lloyd L. King

*Attorney, Agent, or Firm*—J. Raymond Curtin; John S. Sensny

[57] ABSTRACT

A refrigeration circuit comprising serially arranged low and high stage compressors, a condenser, an expansion device, and an evaporator. The circuit also includes by-pass means connecting a low pressure line with the high stage compressor for conducting refrigerant vapor therebetween to by-pass the low stage compressor, and a quench line connected to the by-pass means for conducting liquid refrigerant thereto. A check-quench valve is located at the intersection of the by-pass means and the quench line. The check-quench valve has a quench position blocking the by-pass means and opening the quench line, and a by-pass position opening the by-pass means and closing the quench line.

10 Claims, 3 Drawing Figures

REFRIGERATION CIRCUIT

BACKGROUND OF THE INVENTION

This invention generally relates to refrigeration, and particularly to heat pumps, and even more specifically to heat pumps designed for use in northern climates.

In a typical vapor compression refrigeration circuit, various components, including a compressor, two heat exchangers, and an expansion device, are arranged and operated to transfer heat from one location to another. For example, heat may be transferred from a room within a building to the outdoors, cooling the room. With a heat pump circuit, a reversing valve is provided to reverse refrigerant flow through portions of the circuit so that the circuit may transfer heat not only from a first location to a second, but also from the second location to the first. For example, a first heat exchanger may be located within an enclosure and a second heat exchanger may be located outside the enclosure. In a cooling mode, heat is transferred from the first heat exchanger to the second, cooling the enclosure. In a heating mode, heat is tranferred from the second heat exchanger to the first, heating the enclosure.

Heat pumps operate very effectively, efficiently, and economically under many conditions and, not surprisingly, have found considerable acceptance. However, in certain areas, for example in the northern regions of the United States, heat pumps have heretofore not met with much commercial success. A major reason for this is because the maximum heating load in a room or building in such areas is relatively large, while the typical cooling load is comparatively small; and difficulties have been encountered in providing a heat pump which will effectively satisfy the former and, at a different time, efficiently meet the latter. This difficulty is exacerbated with the common, air to air heat pump—wherein both heat exchangers of the heat pump are in direct heat transfer relation with ambient air—because the capacity of the heat pump to transfer heat from the outdoors to inside an enclosure decreases as the outdoor air temperature decreases. Hence, just as the heating load on the heat pump is increasing, the ability of the heat pump to meet that load is decreasing.

One basic design approach for resolving this difficulty is to provide a heat pump with two serially arranged compressors and with means for selectively conducting refrigerant vapor around one of the compressors to by-pass that compressor. When the demand on the heat pump is small or modest, only one compressor is activated and the other compressor is by-passed; but when the demand on the heat pump is large, both compressors are activated. With both compressors operating in series, the refrigerant vapor is compressed, and thus its temperature is increased, to a greater degree, increasing the capacity of the heat pump.

When two compressors are arranged in series in a heat pump as described above, several potential difficulties are created. One difficulty is to insure that refrigerant vapor is properly routed through the heat pump. That is, through both compressors in series when this is desired, and through only one of the compressors when this is desired. Another difficulty is to insure that, when both compressors operate in series, the refrigerant temperature does not become excessive—that is, reach a level where the refrigerant, or any lubricant mixed with the refrigerant, may chemically decompose. Naturally, it is desirable that the resolution of these difficulties be not only effective and reliable, but also, to the extent consistent with these considerations, simple and inexpensive.

SUMMARY OF THE INVENTION

In view of the above, an object of this invention is to provide a refrigeration circuit which effectively meets a large heating load and also efficiently satisfies a small cooling load.

Another object of the present invention is to provide a refrigeration circuit with a single valve which controls both a compressor by-pass line and a liquid quench line of the circuit.

A further object of this invention is to provide a refrigeration circuit having series compressors with a valve which automatically opens a liquid quench line to cool the refrigerant vapor entering the high stage compressor when the compressors operate in series.

Still another object of the present invention is to provide a refrigeration circuit having two series compressors with a valve which is automatically moved between a by-pass position, opening a first stage compressor by-pass line and closing a liquid quench line of the circuit, and a quench position, blocking the by-pass line and opening the quench line, by vapor pressure within the refrigeration circuit and in response to activation and deactivation of the first stage compressor.

These and other objects are attained with a refrigeration circuit comprising a low stage compressor, a high stage compressor, a condenser, an expansion device, and an evaporator. The refrigeration circuit further comprises refrigerant flow means and a check-quench valve. The refrigerant flow means connects the high and low stage compressors, the condenser, the expansion device, and the evaporator to form a closed, vapor compression refrigeration loop. In particular, the refrigerant flow means includes a low pressure line for conducting refrigerant vapor to the low stage compressor, an interstage line for conducting refrigerant vapor discharged from the low stage compressor to the high stage compressor, by-pass means connecting the low pressure line with the high stage compressor for conducting refrigerant vapor therebetween to by-pass the low stage compressor, and a quench line connected to the by-pass means for conducting liquid refrigerant thereto.

The check-quench valve is located at the intersection of the by-pass means and the quench line and has a quench position and a by-pass position. In the quench position, the check-quench valve blocks the by-pass means and opens the quench line to direct refrigerant from the low pressure line serially through the low stage compressor, through the interstage line, and into the high stage compressor, and to inject refrigerant from the quench line into the refrigerant vapor discharged from the low stage compressor. In the by-pass position, the check-quench valve opens the by-pass means and closes the quench line to direct refrigerant from the low pressure line through the by-pass means and into the high stage compressor to by-pass the low stage compressor.

A BRIEF DESCRIPTION OF THE DRAWINGS

A DETAILED DESCRIPTION OF THE PREFERRED EMBODIMENT

While the preferred embodiment of the present invention is employed as a reversible refrigeration circuit, commonly referred to as a heat pump, it should be understood that the present invention is applicable to refrigeration circuits generally. Thus, the refrigeration circuit of the present invention may be employed solely for heating or cooling, as well as for both heating and cooling. Furthermore, although the disclosed circuit described in detail below includes two compressors, it should be made clear that the refrigeration circuit of the present invention may employ more than two compressors.

Figure 1:
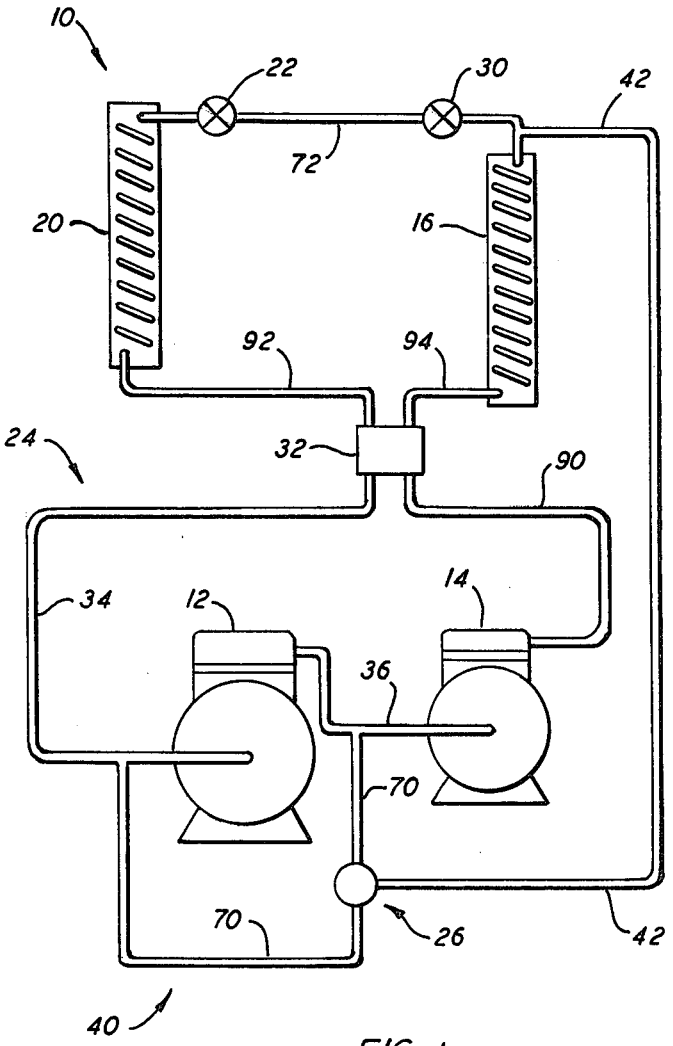
FIG. 1 is a schematic view of a refrigeration circuit in accordance with the present invention.

Referring now to the drawings, FIG. 1 is a schematic illustration of refrigeration circuit 10 in accordance with a preferred embodiment of the present invention. Generally, circuit 10 comprises first or low stage compressor 12, second or high stage compressor 14, heat exchangers 16 and 20, and expansion device 22. Circuit 10 further comprises refrigerant flow means, generally referenced as 24, and check-quench valve 26. Since refrigeration circuit 10 preferably acts as a heat pump, the circuit also includes a second expansion device 30 and reversing valve 32.

Figure 2:
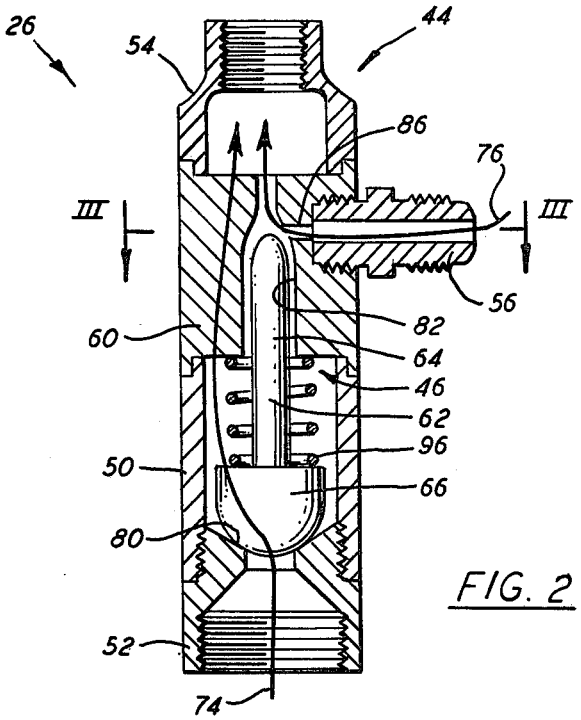
FIG. 2 is a side view, partially in cross section, of the check-quench valve of the refrigeration circuit shown in FIG. 1.
Figure 3:
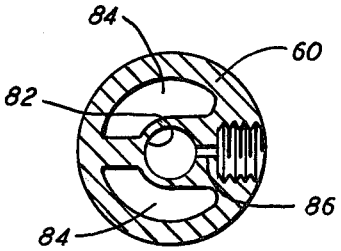
FIG. 3 is a top, cross sectional view of the plunger guide of the check-quench valve, taken along line III—III of FIG. 2.

Briefly, refrigerant flow means 24 includes, inter alia, low pressure line 34, interstage line 36, by-pass means 40, and quench line 42. With reference to FIGS. 2 and 3, check-quench valve 26 preferably comprises body 44 and plunger assembly 46. Body 44 includes central member 50, end members 52 and 54, and quench connector 56; and plunger assembly 46 includes plunger guide 60 and plunger 62. Plunger 62, in turn, preferably includes stem 64 and head 66.

Returning to FIG. 1, compressors 12 and 14, heat exchangers 16 and 20, expansion devices 22 and 30, and reversing valve 32 may all be of a conventional nature. Preferably, of course, each heat exchanger 16 and 20 effectively acts as either a condensor or an evaporator. Also, each expansion device 22 and 30 serves to meter refrigerant flow when refrigerant flows through the expansion device in one direction, and allows a substantially free flow of refrigerant when the direction of the refrigerant flow is reversed.

Refrigerant flow means 24 connects compressors 12 and 14, heat exchangers 16 and 20, expansion devices 22 and 30, check-quench valve 26, and reversing valve 32 to conduct a refrigerant fluid therebetween. In particular, low pressure line 34 is provided for conducting low pressure refrigerant vapor to low stage compressor 12, and interstage line 36 is provided for conducting refrigerant vapor discharged from the low stage compressor to high stage compressor 14. By-pass means 40 connects low pressure line 34 with high stage compressor 14 for conducting refrigerant vapor therebetween to by-pass low stage compressor 12, and quench line 42 is connected to the by-pass means for conducting liquid refrigerant thereto.

Preferably, by-pass means 40 includes by-pass line 70, which is connected to low pressure line 34 and to interstage line 36, and the portion of the interstage line between the by-pass line 70 and high stage compressor 14. Also, preferably, a first end of quench line 42 is connected to by-pass line 70, and a second end of the quench line is connected to a location or region within refrigeration circuit 10 where liquid refrigerant is present when the refrigeration circuit functions in a heating mode to heat an enclosure. For example, the second end of quench line 42 may be connected to interconnecting line 72, which extends between heat exchangers 16 and 20. Specifically, if, as discussed in greater detail below, heat exchanger 16 acts as a condenser and expansion device 22 is used to expand the condensed refrigerant when circuit 10 is in the heating mode, the second end of quench line 42 may be connected to interconnecting line 72, between heat exchanger 16 and the expansion device 22. Alternately, since in many refrigeration applications, liquid refrigerant collects in a downstream or lower portion of the condenser, if the present invention is employed in such an application, the second end of quench line 42 may be connected to the lower or downstream portion of heat exchanger 16.

Check-quench valve 26 is located at the intersection of by-pass means 40 and quench line 42, and has a quench position and a by-pass position. In the quench position, valve 26 blocks by-pass means 40 and opens quench line 42 to direct refrigerant vapor from low pressure line 34 serially through low stage compressor 12, through interstage line 36, and into high stage compressor 14, and to inject refrigerant from quench line 42 into refrigerant vapor discharged from low stage compressor 12, cooling that vapor. In the by-pass position, valve 26 opens by-pass means 40 and closes quench line 42 to direct refrigerant vapor from low pressure line 34 through by-pass means 40 and into high stage compressor 14 to by-pass low stage compressor 12. Simultaneously, valve 26 prevents refrigerant flow through quench line 42, both from and to by-pass means 40.

Referring now to all three Figures in the drawings, preferably check-quench valve 26 defines vapor flow path 74 and quench flow path 76. Vapor flow path 74 is in communication with by-pass means 40 for conducting refrigerant vapor through the check-quench valve, and quench flow path 76 is in communication with quench line 42 for conducting refrigerant fluid therefrom through the check-quench valve. Plunger assembly 46 of valve 26 is supported by and extends within valve body 44 and is movable between a quench position and a by-pass position. In the quench position, plunger assembly 46 closes vapor flow path 74 and allows refrigerant flow through quench flow path 76; and in the by-pass position, the plunger assembly allows vapor flow through vapor flow path 74 and closes quench flow path 76.

More specifically, plunger guide 60 of plunger assembly 46 is supported by and extends within valve body 44 and defines plunger opening 82, vapor opening 84 (only shown in FIG. 3), and quench opening 86. Plunger 62 of assembly 46 is movably supported within body 44 and extends within plunger opening 82. Preferably, a first end of plunger stem 64 extends within plunger opening 82, plunger head 66 is connected to a second end of the plunger stem, and valve body 44 defines valve seat 80 encircling a portion of vapor flow path 74. When plunger assembly 46 is in the quench position, plunger head 66 seats against valve seat 80, preventing vapor flow therepast and through vapor flow path 74. When plunger assembly 46 is in the by-pass position, plunger stem 64 seats against quench opening 86, preventing fluid flow therethrough and through quench flow path 76. Preferably, as plunger assembly 46 moves from the quench position to the by-pass position, plunger 62 moves in a forward direction; while as the plunger assembly moves from the by-pass position to the quench position, the plunger moves in a rearward direction.

Discussing valve body 44 in detail, central member 50 and end members 52 and 54 are all generally tubular or cylindrically shaped, have substantially identical outside diameters, and in assembly are coaxially aligned and secured between portions of by-pass line 70. Bottom end member 52 is threadably secured to central member 50. Plunger guide 60 of plunger assembly 46 is disposed between and is rigidly secured to central body member 50 and top end member 54. Guide 60 may be secured to members 50 and 54, for example, by soldering or welding. Quench connector 56 is threadably secured within a side opening defined by plunger guide 60, connects valve body 44 to quench line 42, and is provided for conducting refrigerant from the quench line to quench opening 86. Top and bottom end members 52 and 54 define external threads for connecting valve 26 to by-pass line 70, and a second end of quench connector 56 defines external threads for connecting valve 26 to quench line 42.

Referring again to plunger assembly 46, plunger guide 60 has a generally cylindrical shape, with an outside diameter equal to that of members 50, 52, and 54 of valve body 44; and, in assembly, the plunger guide is coaxial with members 50, 52, and 54 of the valve body. With this preferred plunger guide 60, plunger opening 82 axially extends through a first portion, preferably a radially central portion, of the plunger guide. Vapor opening 84 axially extends through a second portion, specifically a radially intermediate portion of the plunger guide, and preferably opening 84 comprises two, spaced passages within the plunger guide. Further, quench opening 86 radially extends within plunger opening 60, between quench connector 56 and plunger opening 82. Quench opening 86 is, thus, in communication with plunger opening 82. However, internal surfaces of plunger guide 60 separate openings 82 and 86 from vapor opening 84, preventing fluid from directly passing between either one of the former openings and the latter opening.

Plunger stem 64 axially extends within plunger opening 82 and is supported for sliding movement therewithin. As mentioned above, when plunger assembly 46 is in the by-pass position, stem 64 seats against quench opening 86. Specifically, the side of stem 64 covers and tightly fits against quench opening 86, preventing fluid flow therethrough. Preferably, the surfaces of plunger guide 60 defining plunger opening 82 taper inward at a first or forward end thereof to limit movement of plunger stem 64 therewithin. In addition, preferably quench opening 86 intersects plunger opening 82 along the tapered portion thereof, and a first or forward end of plunger stem 64 also tapers inward, at a taper generally matching that of opening 82. These matching tapers of the surfaces defining plunger opening 82 and of plunger stem 64 guide the forward end of the plunger stem into a relatively tight, pressure fit against quench opening 86 as the plunger stem axially moves forward within the plunger opening.

In addition to the foregoing, preferably quench flow path 76 includes a restricted portion and an enlarged portion for receiving refrigerant therefrom. With this arrangement, refrigerant from quench line 42 expands as the refrigerant passes from the restricted portion of the quench flow path to the enlarged portion thereof, cooling this refrigerant. The quench refrigerant is, hence, better able to maintain the compressed vapor discharged from low stage compressor 12 within a preferred temperature range. With the preferred embodiment of the present invention illustrated in the drawings, quench opening 86 forms the restricted portion of quench flow path 76, and the section of plunger opening 82 which receives refrigerant from the quench opening forms the expanded portion of the quench flow path.

OPERATION

To condition an enclosure or area, of course, a first heat exchanger, for example heat exchanger 16, is placed within the enclosure, and a second heat exchanger, for example heat exchanger 20, is located outside the enclosure.

To cool the enclosure, reversing valve 32 is placed in a first position communicating high pressure discharge line 90 with line 92, which directly connects the reversing valve with outdoor heat exchanger 20, and communicating low pressure line 34 with line 94, which directly connects the reversing valve with indoor heat exchanger 16. Compressor 14 is activated and discharges hot, compressed refrigerant vapor into discharge line 90. The vapor is conducted through line 90, reversing valve 32, and line 92, and into outside heat exchanger 20. The vapor passes through heat exchanger 20, rejecting heat to a cooling medium such as air passing over the heat exchanger. As the refrigerant vapor rejects heat, the vapor condenses, and liquid refrigerant is discharged from heat exchanger 20 into interconnecting line 72. Refrigerant flows through line 72 and through expansion devices 22 and 30. The refrigerant expands as it passes through the latter expansion device, reducing the temperature and pressure of the refrigerant. The expanded refrigerant is conducted through the indoor heat exchanger 16, where the refrigerant absorbs heat from an external heat exchange medium such as indoor air passing over heat exchanger 16. As refrigerant passes through heat exchanger 16, refrigerant fluid vaporizes, and refrigerant vapor is discharged from heat exchanger 16 into line 94. The vapor is conducted through line 94, through reversing valve 32, and into low pressure line 34.

Typically, low stage compressor 12 is not needed to satisfy the cooling load on circuit 10, and low stage compressor 12 is left inactive when circuit 10 is in the cooling mode. Consequently, vapor cannot flow through low stage compressor 12, and vapor passes into by-pass line 70. As vapor passes into by-pass line 70, the vapor pressure rearward of valve 26—that is, in by-pass line 70, between low pressure line 34 and valve 26—increases and forces plunger 62 of the check-quench valve forward therewithin, forcing the check-quench valve to its by-pass position. The vapor flows through by-pass line 70, into interstage line 34, and then into compressor 14, completing the refrigeration cycle.

To heat the enclosure, reversing valve 32 is moved to a second position, communicating discharge line 90 with line 94 and low pressure line 34 with line 92. Now, hot, compressed refrigerant vapor discharged from compressor 14 is conducted through lines 90 and 94 and into indoor heat exchanger 16. Heat exchanger 16 acts as a condenser; and vapor passes therethrough, rejects heat to the ambient, and condenses. Condensed refrigerant is discharged from heat exchanger 16 and is conducted through line 72 and through expansion devices 22 and 30. The refrigerant expands as it passes through the former expansion device, reducing the temperature and pressure of the refrigerant. The expanded refrigerant is conducted through outdoor heat exchanger 20, which now acts as an evaporator. As refrigerant fluid passes through heat exchanger 20, the refrigerant absorbs heat from the ambient and evaporates. The evaporated refrigerant is discharged into line 92, and the refrigerant is conducted therethrough, through valve 32, and into low pressure line 34.

If low stage compressor 12 is not needed to satisfy the heating requirements on circuit 10, the low stage compressor is left inactive. Again, vapor cannot pass through compressor 12, and the vapor passes into by-pass means 40. The vapor pressure rearward of valve 26 increases and forces plunger 44 forward within check-quench valve 26, moving that valve to its by-pass position. Vapor thus passes through valve 26 and into high stage compressor 14, completing the refrigeration cycle. It should be noted that valve 26 also closes quench line 42, preventing refrigerant from possibly by-passing indoor heat exchanger 16.

However, if low stage compressor 12 is needed to satisfy the heating load on circuit 10, the low stage compressor is activated. Low stage compressor 12 draws vapor from low pressure line 34, compresses the vapor, and discharges the vapor into interstage line 36. Now, the pressure of vapor forward of check-quench valve 26—that is, in interstage line 36 and the portion of the by-pass line 70 between the interstage line and the check-quench valve—becomes greater than the pressure of vapor rearward of valve 26. The vapor pressure forward of check-quench valve 26 moves plunger 62 rearward, moving the check-quench valve to the quench position.

Vapor is thus serially directed from low pressure line 34, through low stage compressor 12, interstage line 36, and into high stage compressor 14. At the same time, quench line 42 is open. Cool, liquid refrigerant from interconnecting line 72 is conducted through line 42, valve 26, and by-pass line 70, and into interstage line 36, where the liquid refrigerant mixes with the vapor discharged from low stage compressor 12. The liquid refrigerant cools this vapor, preventing the vapor from reaching temperature levels where the refrigerant, or any lubricant mixed therein, may begin to decompose chemically. Moreover, by decreasing the vapor temperature, the vapor mass flow rate is increased, increasing the efficiency of the second stage compressor 14. It should be pointed out that a weak spring 96 may be disposed between plunger head 66 and plunger guide 60, urging plunger 62 to the quench position to help check-quench valve 26 quickly move to the quench position after low stage compressor 12 is activated.

Thus, as may be understood from a review of the above discussion, the refrigeration circuit of the present invention may be employed to satisfy a large heating load effectively and, at a different time, meet a small cooling load efficiently. More specifically, by activating both compressors 12 and 14 the capacity of circuit 10 is substantially increased, allowing the circuit to satisfy a large load. However, when only one compressor is activated, circuit 10 has a much smaller capacity; and the circuit 10 is able to operate at a relatively large percentage of this capacity, and thus is able to operate very efficiently, when a small load is placed on the refrigeration circuit. Valve 26 insures that refrigerant vapor is accurately routed either through or past low stage compressor 12, depending on the desired operation of circuit 10; and the same valve 26 controls liquid quench line 42 to insure that, when both compressors 12 and 14 operate in series, the hot refrigerant vapor discharged from the low stage compressor 12 is cooled to prevent that vapor from reaching excessive temperature levels. Valve 26 is relatively simple and inexpensive, yet is reliable and effective. Moreover, the valve 26 may be, and preferably is, operated by vapor pressure within adjacent portions of refrigeration circuit 10 and moved between its quench and by-pass positions in response to activation and deactivation of compressor 12, eliminating the need for any external sensors or controls and their associated cost and complexity.

While it is apparent that the invention herein disclosed is well calculated to fulfill the objects stated above, it will be appreciated that numerous modifications and embodiments may be devised by those skilled in the art, and it is intended that the appended claims cover all such modifications and embodiments as fall within the true spirit and scope of the present invention.

What is claimed is:

1. A refrigeration circuit comprising:

a low stage compressor, a high stage compressor, a condenser, an expansion device, and an evaporator;

refrigerant flow means connecting the high and low stage compressors, the condenser, the expansion device, and the evaporator to form a closed, vapor compression refrigeration loop, and including a low pressure line for conducting refrigerant vapor to the low stage compressor, an interstage line for conducting refrigerant vapor discharged from the low stage compressor to the high stage compressor, by-pass means connecting the low pressure line with the high stage compressor for conducting refrigerant vapor therebetween to by-pass the low stage compressor, and a quench line connected to the by-pass means for conducting liquid refrigerant thereto; and a check-quench valve located at the intersection of the by-pass means and the quench line and having a quench position blocking the by-pass means and opening the quench line to direct refrigerant from the low pressure line serially through the low stage compressor, through the interstage line, and into the high stage compressor, and to inject refrigerant from the quench line into the refrigerant vapor discharged from the low stage compressor, and a by-pass position opening the by-pass means and closing the quench line to direct refrigerant from the low pressure line through the by-pass means and into the high stage compressor to by-pass the low stage compressor.

2. A refrigeration circuit as defined by claim 1 wherein:

the check-quench valve defines a vapor flow path in communication with the by-pass means for conducting refrigerant vapor through the check-quench valve, and a quench flow path in communication with the quench line for conducting refrigerant fluid therefrom through the check-quench valve; and the check-quench valve includes a body, and a plunger assembly supported by and extending within the body and movable between a quench position, wherein the plunger assembly closes the vapor flow path and allows refrigerant flow through the quench flow path, and a by-pass position, wherein the plunger assembly allows vapor flow through the vapor flow path and closes the quench flow path.

3. A refrigeration circuit as defined by claim 2 wherein the plunger assembly includes:

a plunger guide supported by and extending within the body and defining a vapor opening forming a portion of the vapor flow path, a quench opening forming a portion of the quench flow path, and a plunger opening; and a plunger movably supported within the body and extending within the plunger opening.

4. A refrigeration circuit as defined by claim 3 wherein:

The plunger moves in a forward direction when the plunger assembly moves from the quench position to the by-pass position, and the plunger moves in a rearward direction when the plunger assembly moves from the by-pass position to the quench position;

when the low stage compressor is activated, vapor pressure forward of the check-quench valve becomes greater than the vapor pressure rearward thereof, and the vapor pressure forward of the check-quench valve moves the plunger into the quench position; and when the low stage compressor is deactivated, vapor pressure rearward of the check-quench valve becomes greater than the vapor pressure forward thereof, and the vapor pressure rearward of the check-quench valve moves the plunger into the by-pass position.

5. A refrigeration circuit as defined by claims 3 or 4 wherein:

the body defines a valve seat encircling a portion of the vapor flow path;

the plunger includes a plunger stem having a first end extending within the plunger opening, and a plunger head connected to a second end of the plunger stem; and when the plunger assembly is in the quench position, the plunger head seats against the valve seat, and when the plunger assembly is in the by-pass position, the plunger stem seats against the quench opening.

6. A refrigeration circuit as defined by claim 5 wherein:

the plunger opening axially extends through a first portion of the plunger guide;

the vapor opening axially extends through a second portion of the plunger guide;

the quench opening radially extends within the plunger guide, in communication with the plunger opening; and surfaces of the plunger guide separate the plunger opening and the quench opening from the vapor opening.

7. A refrigeration circuit as defined by claim 6 wherein the first end of the plunger stem tapers inward; and the surfaces of the plunger guide defining a first end of the plunger opening taper inward to limit movement of the plunger stem therein and to facilitate tightly seating the plunger stem against the quench opening.

8. A refrigeration circuit as defined by claim 3 wherein the body includes a quench connector connecting the body to the quench line for conducting refrigerant from the quench line to the quench opening.

9. A refrigeration circuit as defined by claim 2 wherein the quench flow path includes a restricted portion and an enlarged portion for receiving refrigerant therefrom, wherein refrigerant from the quench line expands as the refrigerant passes from the restricted portion to the enlarged portion.

10. A refrigeration circuit as defined by claim 9 wherein the plunger assembly includes:

a plunger guide supported by and extending within the body and defining a vapor opening, a quench opening, and a plunger opening in communication with the quench opening, wherein the vapor opening forms a portion of the vapor flow path, the quench opening forms the restricted portion of the quench flow path, and a section of the plunger opening forms the enlarged portion of the quench flow path; and a plunger movably supported within the body and extending within the plunger opening.

* * * * *